United States Patent [19]

Garcia

[11] Patent Number: 4,510,930

[45] Date of Patent: Apr. 16, 1985

[54] BREATHABLE GAS DISTRIBUTION APPARATUS

[75] Inventor: Elmer D. Garcia, Los Alamos, N. Mex.

[73] Assignee: The United States of America as represented by the United States Department of Energy, Washington, D.C.

[21] Appl. No.: 473,390

[22] Filed: Mar. 8, 1983

[51] Int. Cl.[3] ..... A62B 7/02

[52] U.S. Cl. ..... 128/202.22; 128/205.24; 128/204.18; 128/205.25

[58] Field of Search ..... 128/202.13, 201.28, 128/202.27, 202.22, 204.18, 204.25, 205.12, 205.24, 205.23, 205.19, 205.25; 222/3, 6; 137/883

[56] References Cited

U.S. PATENT DOCUMENTS

| | | | |
|---|---|---|---|
| 2,267,009 | 12/1941 | Adolphsen et al. | 128/202.22 |
| 2,300,273 | 10/1942 | Connell | 128/205.24 |
| 3,208,449 | 9/1965 | Bartlett, Jr. | 128/204.18 |
| 3,400,732 | 9/1968 | Larrabee | 137/883 |
| 3,811,400 | 5/1974 | Smilg | 128/202.22 |
| 3,976,067 | 8/1976 | Amlong | 128/205.24 |
| 4,165,738 | 8/1979 | Grimes et al. | 128/202.13 |
| 4,413,622 | 11/1983 | Austin | 222/3 |

FOREIGN PATENT DOCUMENTS

| | | |
|---|---|---|
| 348546 | 2/1922 | Fed. Rep. of Germany . |

*Primary Examiner*—Henry J. Recla

*Attorney, Agent, or Firm*—Lee W. Huffman; Paul D. Gaetjens; Judson R. Hightower

[57] ABSTRACT

The disclosure is directed to an apparatus for safely supplying breathable gas or air through individual respirators to personnel working in a contaminated area.

9 Claims, 1 Drawing Figure

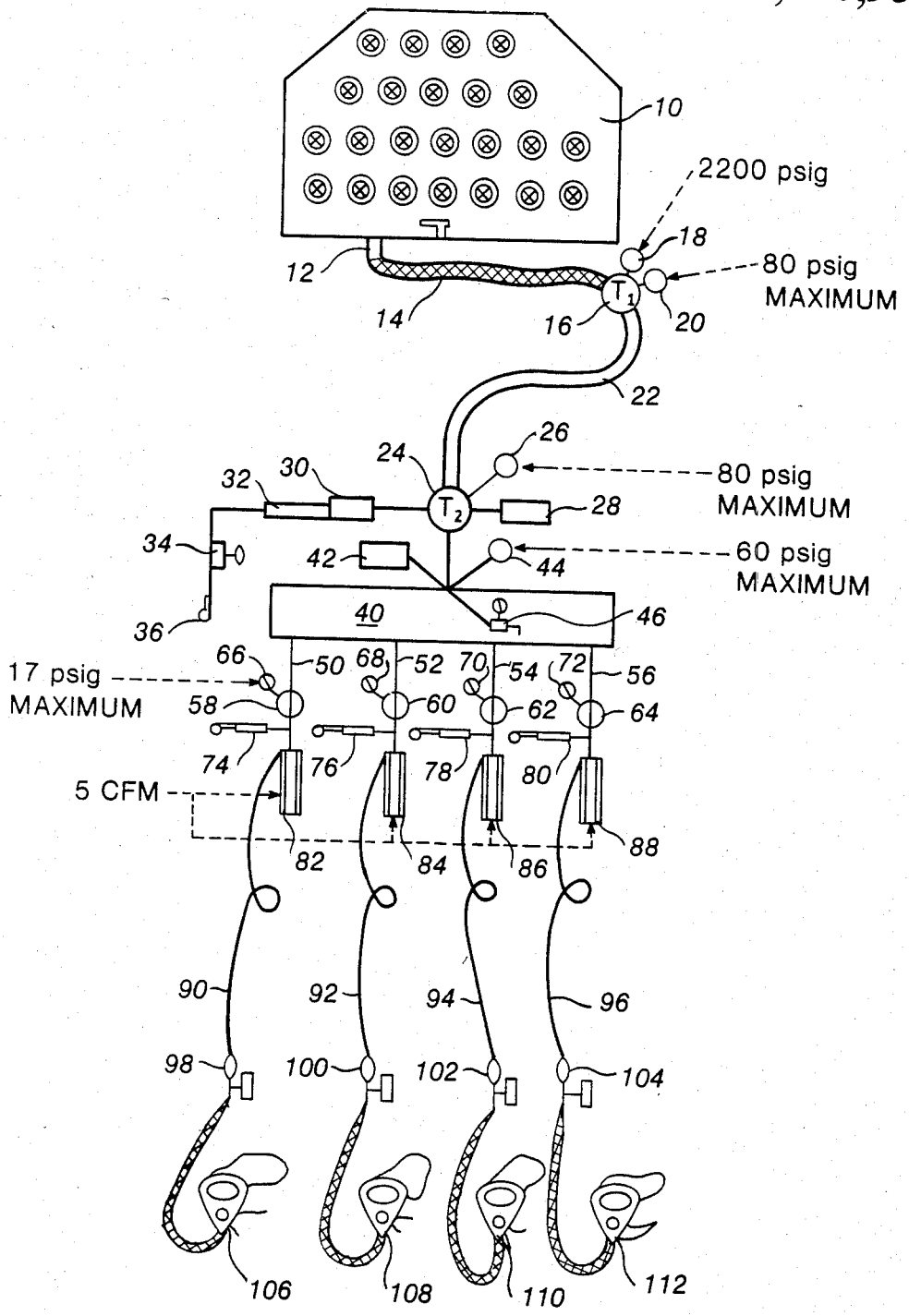
10
2200 psig
18
12
80 psig
MAXIMUM
14
16
20
22
26
24
80 psig
MAXIMUM
32
30
28
34
42
44
60 psig
MAXIMUM
40
46
36
66
50
68
52
70
54
72
56
17 psig
MAXIMUM
58
60
62
64
74
76
78
80
5 CFM
82
84
86
88
90
92
94
96
98
100
102
104
106
108
110
112

BREATHABLE GAS DISTRIBUTION APPARATUS

This invention is the result of a contract with the Department of Energy (Contract No. W-7405-ENG-36).

BACKGROUND OF THE INVENTION

The field of the invention relates to gas distribution apparatus and particularly to apparatus for distributing breathable gas from a very high pressure source to individual respirators at suitable pressure over atmospheric pressure for their comfortable use.

In industrial and research environments it is at times necessary for personnel to enter contaminated areas in order to clean them, change filtering units and the like. Such areas may be contaminated by chemicals, biological agents and radioactive material. When personnel must enter such areas they wear suitable protective clothing and although they are only in the area for a short time because of the great dangers inherent in exposures in such areas, they are in the areas for a sufficient length of time that they require breathing apparatus. In some cases individuals carry apparatus such as air tanks on their backs. However, manually carried tanks are heavy and cumbersome, will be contaminated in use, cannot be reused, and must be carefully treated as waste. In addition, they may interfere with the protective clothing necessarily worn by the individuals going into the contaminated areas. If possible, it is usually desirable that air from a source outside the contaminated area be ducted through hoses into the room, vault or other contaminated area needing clean up. Typical breathing apparatus comprises individual full-face masks well known to those skilled in the art. Such face masks connect to a source of air or other breathable gas such as a mixture of oxygen and nitrogen through individual conduits or hoses which enter a vault or room through sealable wall ports. After their use, at least in radioactive environments, the hoses which carry the air or gas as well as the face masks are burned or otherwise suitably destroyed. They almost never can be removed from radioactively contaminated areas and reused.

With prior art devices, it has been very difficult to safely control air pressure at each individual face mask and if pressure to a mask is inadequate an individual wearing it may rip it off and breath the contaminated air. In the worst case death could result. At best some chemical or radioactive material is absorbed and medical treatment of the individual is required. If pressure to a face mask is too high it is extremely uncomfortable for an individual to continue to wear the mask and work in the contaminated area, usually necessarily for several hours. Using typical prior art devices, if air is cut off to one of a plurality of individual face masks, such as from a kink in the hose to that mask, pressure increases to other face masks connected to the same air supply. This too is highly undesirable and extreme discomfort from excessive pressure results to the wearers of the other face masks.

One object of the present invention is to provide a regulated supply of air or breathable gas to individuals working in contaminated areas.

Another object of the present invention is to provide a series of air pressure relief valves and alarms so that air or breathable gas pressure does not increase above a desirable level at face masks of personnel working in contaminated areas, and if it is about to, they are warned.

Another object of the present invention is to distribute air or other breathable gas to a plurality of individuals working in a contaminated area in a manner that pressure at each face mask is independent of the pressure at all others so that in case of accident or crimping of a hose, pressures do not rise above a desirable amount in the remaining masks.

One advantage of the instant invention is that at least one of a series of alarms initiates if air pressure exceeds a desired amount.

Another advantage of the instant invention is that gauges are disposed at critical pressure reduction parts of the apparatus thereby providing for monitoring outside the contaminated area being serviced.

A third advantage of the instant invention is that a plurality of audible alarms are provided if gas pressure exceeds a limit amount at any one of several stages of pressure reduction.

Another advantage of the instant invention is that a preferred embodiment thereof is portable and may be readily carried about on a push cart and can be easily taken to a contaminated area requiring immediate attention.

SUMMARY OF THE INVENTION

In accordance with the present invention there is provided an apparatus for safely supplying, at controlled pressure and flow rate, from a source of very high pressure, breathable gas such as air to personnel through respirators. The apparatus comprises a first pressure regulator for reducing pressure from the high pressure source to a greatly reduced pressure well-above atmospheric pressure. A second pressure regulator having a pressure relief valve attached thereto further reduces the pressure. An audible alarm is also connected to the second pressure regulator. A manifold connects to the second pressure regulator and distributes air through a plurality of conduits. A relief valve and audible relief valve alarm are disposed on each of the conduits which connect to individual flow meters. The flow meters control the flow of air to hoses to maintain desired flow rate and pressure to individual respirators. Pressure gauges are disposed at each of the pressure regulators so that visual monitoring can be carried out.

BRIEF DESCRIPTION OF THE DRAWING

The accompanying drawing, which is incorporated in and forms a part of the specification, illustrates a preferred embodiment of the present invention and, together with the description, serves to explain the principles of the invention. In the drawing:

The FIGURE is a schematic showing of an air distribution apparatus in accordance with the invention.

DETAILED DESCRIPTION OF A PREFERRED EMBODIMENT OF THE INVENTION

The FIGURE schematically illustrates a preferred embodiment of the present invention. As seen therein, air or other breathable gas such as a combination of oxygen and nitrogen contained in a source 10 such as a tank truck passes through a high pressure hose 14 attached to a spigot 12 on the source 10. Hose 14 connects to a first pressure regulator 16 having attached thereto a gauge 18 for reading the pressure from the source 10 and a gauge 20 for reading the output pressure of the regulator. The preferred embodiment of the invention utilizes air from a standard industrial source of 2200 psig and reduces the 2200 psig to a maximum of 80 psig. It will be appreciated by those skilled in the art that the invention is not restricted to the specific pressure reductions of the preferred embodiment but is addressed to ranges of pressure reductions. Many situations to which the invention may be applied will require substantially different pressure reductions and may use a source of high pressure air or other gas at other than 2200 psig. From first pressure regulator 16 the breathable gas or air passes through a second hose 22 to a second pressure regulator 24. In the preferred embodiment second pressure regulator 24 drops the pressure from a maximum of 80 psig to a maximum of 60 psig. A gauge 26 connects to second pressure regulator 24 and reads the entering pressure to the regulator. A pressure relief valve 28 is provided at second pressure regulator 24. Additionally connected to second pressure regulator 24 is a low pressure alarm system comprising a pressure switch and electrical alarm 30, a manual low pressure relief valve 32, a normally open valve 34 and a whistle 36. When the apparatus is in use the valve 34 is open, it being closed only while the system is being pressurized. If pressure drops below 20 to 10 psig, element 32 allows gas or air to escape through valve 34 and thereby blow whistle 36 which in the preferred embodiment is a standard referee's or policeman's metal whistle epoxied to output conduit connected to valve 34. Electrical alarm 30 will have sounded when pressure dropped below 40 to 30 psig. A manifold 40 connects to regulator 24 through conduit. A pressure relief valve 42 and pressure gauge 44 attach to manifold 40 at its connection to the conduit. Gauge 44 reads the pressure entering the manifold, 40 in the case of the preferred embodiment 60 pounds. A pressure relief switch 46 is also provided there. Gas enters manifold 40 in the preferred embodiment at 60 psig maximum and exits it at 17 psig maximum through a plurality of conduits 50, 52, 54, and 56. Although four conduits are utilized in the preferred embodiment, it will be readily apparent to those skilled in the art that any reasonable number of conduits can be used and that the number used will depend upon the particular application contemplated. Pressure regulators 58, 60, 62, and 64 having pressure valves 66, 68, 70, and 72 attach to conduits 50, 52, 54, and 56, respectively. Attached between regulators 58, 60, 62, and 64 and flowmeters 82, 84, 86 and 88 are pressure relief valve and alarm combinations 74, 76, 78, and 80 which in the preferred embodiment comprise relief valves and referee's whistles. Flowmeters 82, 84, 86, and 88 control the flow rate and pressure going to individual breathing apparatus such as masks 106, 108, 110, and 112 through flexible hoses 90, 92, 94, and 96 and normally open valves 98, 100, 102, and 104. If only two or three individuals use the masks, the valves to the unused masks are closed and the masks are left on a portable cart which holds everything from first pressure regulator 16 through the masks when they are not in use.

In operation, if a routine or emergency decontamination job is to be done, the source 10 such as a tank truck is driven to a building or the contaminated area. High pressure line 14 from source 10 feeds gas or air to a cart which contains the apparatus of the invention just outside the contaminated room or area. All the valves necessary for operation are open and the masks are donned in addition to protective clothing suitable for the job to be done. The hoses 90, 92, 94 and 96 pass through sealed apertures in a wall of the room in the case of a radiation contaminated room. After use, hoses and masks brought into the contaminated area are burned or otherwise properly destroyed. If pressure exceeds what it should at any stage in pressure reduction, the appropriate relief valve or valves will provide gas or air to the whistle or whistles which will blow, giving an audible alarm. If pressure drops too low, electric alarm 30 sounds between 40 to 30 psig. If pressure drops further to between 20 to 10 psig manual alarm 36 sounds. At least one person is stationed at the cart to monitor all the gauges while the decontamination is being carried out. In the preferred embodiment the gauges are color coded so that when pressure is satisfactory the needle of the gauge is in a green area. If pressure gets too high the needle moves into a red area.

The foregoing description of the preferred embodiment of the invention has been presented for purposes of illustration and description. It is not intended to be exhaustive or to limit the invention to the precise form disclosed, and obviously many modifications and variations are possible in light of the above teaching. The preferred embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

I claim:

1. An apparatus for safely supplying breathable gas to personnel at a controlled pressure and flow rate from a source of very high pressure, said apparatus comprising:

first pressure regulator means operably connected to said gas source for reducing pressure from said high pressure source to a greatly reduced pressure, well above atmospheric pressure;

second pressure regulator means operably connected to said first pressure regulator means for reducing gas pressure further;

first overpressure relief means operably connected to said second pressure regulator means;

low pressure audible alarm means operably connected to said second pressure regulator means;

manifold means operably connected to said second pressure regulator means for receiving said breathable gas;

a plurality of conduits operably connected to said manifold means, each conduit in said plurality thereof for conducting said breathable gas;

second overpressure relief valve means and overpressure valve audible alarm means operably connected to each of said plurality of conduits;

flow meter means connected to each of said conduits for controlling the flow of breathable gas through each of said conduits at a desired flow rate and pressure; and a plurality of individual breathing apparatuses, each individual breathing apparatus therein being singularly connected to one conduit in said plurality thereof for receiving said breathable gas conducted from said manifold means.

2. The apparatus of claim 1 wherein said flow meter means comprises a flow meter connected to each conduit.

3. The apparatus of claim 1 further comprising second pressure relief means operably connected to said manifold means.

4. The invention of claim 1 further comprising means for detecting too low a pressure operably connected to said second pressure regulator means.

5. The invention of claim 1 further comprising pressure gauges operably disposed at said first and second pressure regulator means, on said manifold means and on said conduits between said manifold means and said relief valve means.

6. The invention of claim 1 wherein said first pressure regulator means receives gas at over about 2000 psig and reduces it to a pressure between about 65 and about 100 psig.

7. The invention of claim 6 wherein said second pressure regulator means reduces pressure from the about 65 to about 100 psig range to between about 50 to about 70 psig.

8. The invention of claim 7 wherein said manifold means reduces pressure from the about 50 to about 70 psig range to between about 15 and about 19 psig.

9. The invention of claim 8 wherein said breathable gas delivered through said conduits to each of the individual breathing apparatuses is between about 4 and about 15 psig.

* * * * *